US006986697B2

(12) United States Patent
Luk

(10) Patent No.: US 6,986,697 B2
(45) Date of Patent: Jan. 17, 2006

(54) EMPAISTIC CUP FOR A BRASSIERE

(75) Inventor: Theone Luk, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 24 days.

(21) Appl. No.: 10/349,530

(22) Filed: Jan. 21, 2003

(65) Prior Publication Data

US 2004/0142632 A1 Jul. 22, 2004

(51) Int. Cl.
*A41C 3/00* (2006.01)

(52) U.S. Cl. ..... 450/57; 450/55

(58) Field of Classification Search ..... 450/53–57.1; 2/267, 268, 244, 246, 243.1; 156/245; 264/257, 264/258, 291–294, 320, 321, 145, 148, 152–155, 264/157, 160, 163

See application file for complete search history.

(56) References Cited

U.S. PATENT DOCUMENTS 3,947,207 A * 3/1976 Magidson et al. ..... 425/398
4,013,750 A * 3/1977 Magidson et al. ..... 264/136
4,080,416 A * 3/1978 Howard ..... 264/258
4,148,322 A * 4/1979 Jacaruso et al. ..... 450/40
5,154,659 A * 10/1992 Gluckin ..... 450/39

* cited by examiner

*Primary Examiner*—Gloria M. Hale
(74) *Attorney, Agent, or Firm*—Ostrolenk, Faber, Gerb & Soffen, LLP

(57) ABSTRACT

A decoratively patterned, laminated brassiere, including an outer fabric layer, a foam core and an inner fabric layer. The outer fabric layer having embossing therein to define the decorative pattern of the brassiere, the core having a corresponding embossed pattern in the surfaces thereof underlying the fabric layer and which is impressed through the latter into the core so that the material of the core impregnates the fabric layer to permanently retain the decorative pattern therein.

10 Claims, 2 Drawing Sheets

FIGURE 4
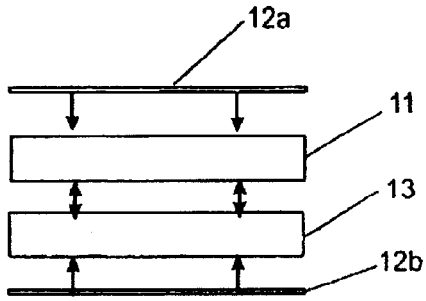
FIGURE 5
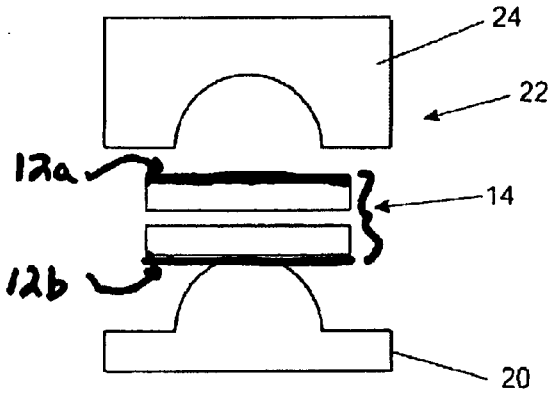
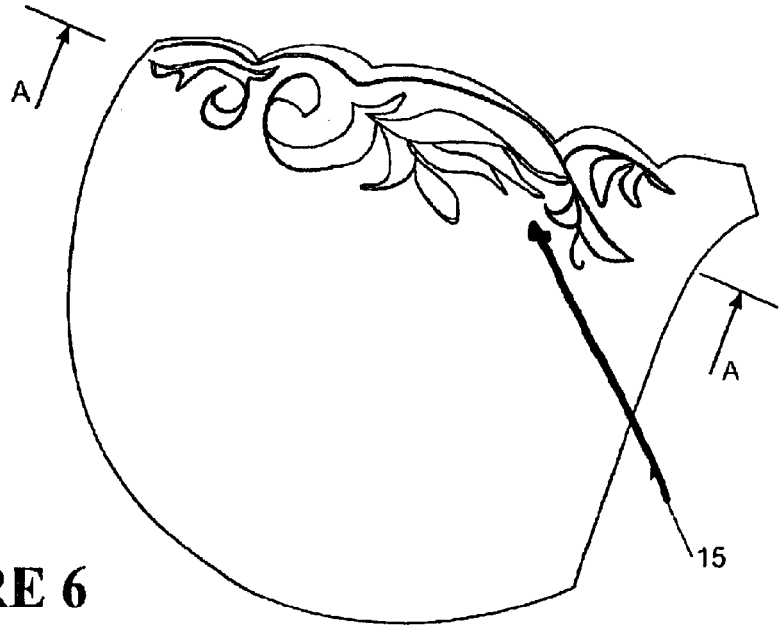
FIGURE 6

EMPAISTIC CUP FOR A BRASSIERE

FIELD OF INVENTION

This invention relates generally to brassieres, slips or other articles of feminine wearing apparel, and/or methods of manufacturing same.

BACKGROUND

It is often desirable in the manufacture of brassieres to include embossed decorative or ornamental designs to enhance the appearance thereof, and which may be correlated with the patterns of lace or other decorative fabrics included in the associated garments or wearing apparel.

Prior art attempts at permanent decorative embossing may not be capable of withstanding the repeated launderings to which wearing apparel are usually subjected.

It would also be desirable to include decorative embossing but which would only appear on the outer or exposed surface of the cups while the inner surface, which is in contact with the wearer's body, remains smooth for optimum comfort to the wearer.

SUMMARY OF INVENTION

It is an object of the present invention to provide a brassiere and/or method of manufacturing same that goes some way to overcoming the abovementioned disadvantages in the prior art, achieving some of the abovementioned desideratum or which will at least provide the public with a useful choice.

In a first aspect, the present invention consists in a decoratively patterned, laminated cup for a brassiere, comprising at least one outer fabric layer, and a foam core;

wherein said outer fabric layer having a portion including embossing therein to define the decorative pattern of the cup, the core having a corresponding embossed pattern in a portion of the surfaces thereof underlying said outer fabric layer and which is impressed or impregnated through, or adhered to said outer fabric layer to permanently retain the decorative pattern therein.

Preferably said cup further comprises an inner fabric layer on the opposite side of said core to said outer fabric layer.

Preferably said cup further comprises a further foam core and an inner fabric layer on the opposite side of said core to said outer fabric layer.

In a second aspect the present invention consists in a method of manufacturing a cup for brassiere comprising the steps providing a laminate comprising at least an elastic foam layer and an elastic fabric layer, heating said laminate until said foam layer becomes at least plastic, and compressing said laminate with an engraved or embossed mold on at least the fabric layer side.

In a third aspect the present invention consists in a brassiere including two cups, the improvement comprising that at least one said cups comprising:

at least one outer fabric layer, and a foam core;

wherein said outer fabric layer having a portion including embossing therein to define the decorative pattern of the cup, the core having a corresponding embossed pattern in a portion of the surfaces thereof underlying said outer fabric layer and which is impressed or impregnated through said outer fabric layer to permanently retain the decorative pattern therein.

Preferably the improvement further comprises an inner fabric layer on the opposite side of said core to said outer fabric layer.

Preferably the improvement further comprises a further foam core and an inner fabric layer on the opposite side of said core to said outer fabric layer.

In a fourth aspect the present invention consists in a method of forming a brassiere including two cups the improvement comprising that at least one of said cups is formed according to at least the steps of:

providing a laminate comprising at least an elastic foam layer and an elastic fabric layer, heating said laminate until said foam layer becomes at least plastic, and compressing said laminate with an engraved or embossed mold on at least the fabric layer side.

In a fifth aspect the present invention consists in a computer aided method of forming a cup for a brassiere comprising the steps of receiving input relating to the design and/or dimensions of said cup and storing said input;

determining the design and/or dimensions of two mold halves based on said input for molding said cup; and molding a laminate between said mold halves to form said cup.

Preferably the method further comprises the step of forming said mold halves based on said determined design and/or dimensions.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

The preferred forms of the present invention will now be described with reference to the accompanying drawings in which:

FIG. 4 is a cross section of the 4 layer laminate, FIG. 5 is a cross section of the 4 layer molding process, and FIG. 6 is a perspective view of the completed embossed cup.

DETAILED DESCRIPTION

The present invention allows a permanent pattern to be embossed on the cups of a molded brassiere.

Figure 1:
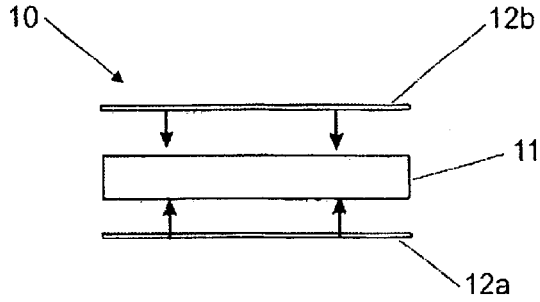
FIG. 1 is a sectional view illustrating the manner in which fabric either side of a core of foam material is laminated during the production of an embossed cup in accordance with a preferred embodiment of the invention.

Referring to the drawing in detail, and initially to FIG. 1 thereof; it will be noted that a composite material embodying the present invention and generally identified by the reference numeral 10, is of the laminated type and includes a relatively thin liner core 11 of elastic foam, such as, for example, polyurethane or the like, and an elastic textile fabric 12*a* 12*b* of cotton, or other suitable fibre, natural or synthetic, around the core 11 so as to envelop the latter. The core is preferably of a sufficient density to retain the embossing over normal life of the garment. In case of polyurethane foam a density of at least 25 kg/m$^3$ is preferred.

The woven textile fabric forms an inner or bottom layer 12*a* and an upper or outer layer 12*b* about the core 11.

The inner and outer layers 12*a* and 12*b* of fabric are bonded together by pressing together such layers while the material of core 11 is in a semi plastic or molten condition such that the material of core 11 impregnates at least in part the fibres of the fabric layers and, upon setting thereof, forms a secure bond therewith. Suitable adhesive as known in the art can be applied to the surfaces to be bonded in order to improve the bonding.

Making the Mold

A pattern (such as a flower pattern) is first hand drawn with (for example) a black marker on a plastic cup of the intended shape and size for the bra to be produced. The pattern can be on any side or both sides of the cup. Then a 3-D scanner is used to scan the shape of and the pattern on the plastic cup to form a 3-D scanned image. The scanned image consists of pixels and may need to be "smoothed" to form the lines of the pattern. The design of the shape of the cup and the pattern thereon will then be finalized and stored in a computer. Alternatively the design may be completely generated within the computer using known 3D graphic or CAD software tools. The computer then controls and drives a milling machine to mill the pattern on and the shape of the cup onto the molds. The molds will then be used in the molding machine for making the bra cup.

Making the Breast Cup

Figure 3:
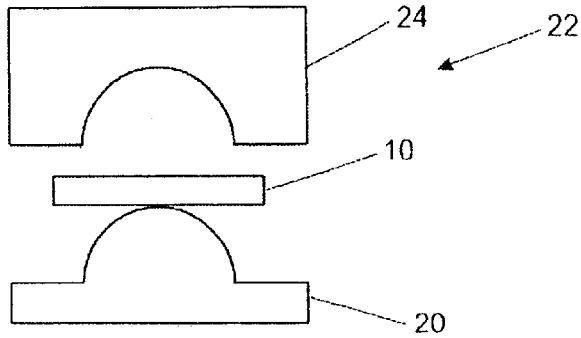
FIG. 3 is a cross section of the moulding process, of the lay up FIG. 1.

The foam core 11 and the fabric 12*a* and 12*b* are laminated together as shown in FIGS. 3 and 5. The foam core 11 is cut to the size and shape as needed. The cut foam core 11 is loaded into the molding machine 22 shown in FIG. 3 in between the upper mold half 24 and lower mold half 20. The top mold half 24 is pressed down onto the laminate 10 for, for example, 120 seconds. The temperature of the upper mold half 24 is for example 198° C. and the temperature of the lower half mold 20 is for example 202° C. The temperature of the lower mold half 20 would in general be higher than that of the upper mold half 24, due to heat dissipation as a result of the repeated opening and closing action of the upper mold half 24. The foam and the fabric will then form a cup shape with the embossed pattern 15 formed thereon as seen in FIG. 6.

Figure 2:
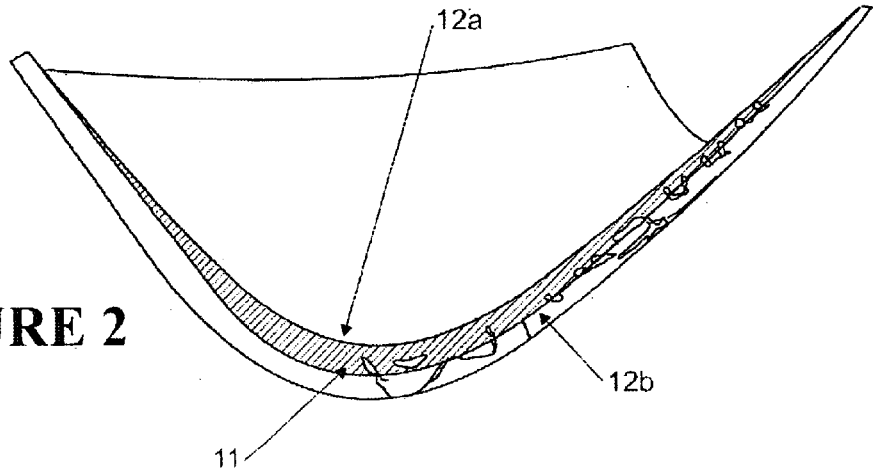
FIG. 2 is a sectional view of an embossed cup produced from foam core and fabric of FIG. 1 along the line AA of FIG. 6.

It has been found that, where the core 11 underlies the upper or outer layer 12*b* of textile fabric, the embossing 15 of the latter is transmitted to the core, that is, the raised portions of the design in the upper fabric layer 12*b* are filled or supported by correspondingly raised portions of the core, as is clearly apparent in FIG. 2. Further, the core impregnates the fabric 12*a*, 12*b* so that, when the core has set, the pattern or design 15 embossed in the upper fabric layer 12*b* tends to be permanently retained by the foam core 11 even after repeated launderings of the laminate 10.

In the absence of the core 11, embossing 15 of the material is not permanently retained and further results in the transmission of the embossed pattern to the lower or inner surface of the material, and in weakening of the textile fabric. Thus, in the material 10 embodying the present invention, the core 11 performs the multiple functions of retaining the embossed design or pattern 15 in the upper or outer surface of the material, of permitting the restriction of the embossed design or pattern 15 merely to the outer layer or surface of the material so that a smooth lower or inner surface can be maintained, and further of retaining the material in the desired shape, that is, preventing deformation during use.

With certain breast cup designs the outer fabric 12*b* (the fabric further away from the skin) will be subject to much greater tensile force than the inner fabric 12*a* and may thus be overly stretched resulting in less desirable "hand" feel. This problem can be reduced (assuming the same cup thickness) if two foam panels are molded, each with only single sided fabric. Referring to FIGS. 4 and 5 it is seen the inner foam 13 and outer foam 11 can be molded separately or integrated in one step to a 4 ply laminate 14.

Making the Bra

The completed breast cup may be sewn together with the straps, underwire, elastic and any decorative additions to form the brassiere. Alternatively a one piece brassiere could be formed completely with the laminate molded to the required shape. The brassiere may include over shoulder straps, strapless or other configuration as are known of the art. The embossed patterns need not be on the cup but on any part of the article made from the laminate for example the straps. Also the brassiere or the embossed cups may form part of a larger garment.

FIG. 6 shows a cup having an embossed decorative pattern 15.

It will be appreciated that other forms of manufacture are possible without departing from the scope of the invention. For example the outer fabric layers could be adhered to the core. The adhesive may be surface applied or sprayed to the core. The layers are then hot pressed to form the cup.

What is claimed is:

1. A decoratively patterned, laminated cup for a brassiere, comprising at least one outer fabric layer including a first embossed decorative pattern therein; and a first foam core having a first surface underlying the outer fabric layer, the first surface of the first foam core having a second embossed decorative pattern aligned with the first embossed decorative pattern of the fabric layer;

wherein the first surface of the first foam core having the second embossed decorative pattern is at least one of impressed, impregnated through, or adhered to the outer fabric layer to permanently retain the embossed decorative pattern of the fabric layer on the first surface of the first foam core.

2. A cup as claimed in claim 1, wherein the first foam core has a second surface opposite the first surface, the cup further comprising an inner fabric layer on the second surface of the first foam core.

3. A cup as claimed in claim 1, wherein the first foam core has a second surface opposite the first surface, the cup further comprising:

a second foam core having a third surface facing the second surface of the first foam core and having a fourth surface opposite the third surface; and an inner fabric layer on the fourth surface of the second foam core.

4. A method of manufacturing a cup for brassiere comprising the steps providing a laminate including a first elastic foam layer having a first outer surface and a first elastic fabric layer on the first outer surface of the first elastic foam layer;

heating the laminate until the first elastic foam layer becomes plastic; and compressing the laminate with an engraved or embossed mold on the first outer surface of the laminate having the first elastic fabric layer.

5. A method as claimed in claim 4 wherein the first elastic foam layer has a first inner surface, the laminate further includes a second elastic foam layer having a second inner surface facing the first inner surface of the first elastic foam layer and a second outer surface, and the laminate further includes a second fabric layer on the second outer surface of the second elastic foam layer.

6. A brassiere, comprising: first and second cups of claim 1 coupled to one another.

7. The brassiere of claim 6, wherein the first foam core of each cup has a second surface opposite the first surface, and each cup further includes an inner fabric layer on the second surface of the first foam core.

8. The brassiere of claim 6, wherein the first foam core of each cup has a second surface opposite the first surface, and each cup further includes:

a second foam core having a third surface facing the second surface of the first foam core and having a fourth surface opposite the third surface; and an inner fabric layer on the fourth surface of the second foam core.

9. A method of forming a brassiere, comprising:

providing two cups, at least one of the cups being manufactured in accordance with the method of claim 4; and coupling the two cups together to form the brassiere.

10. A method of forming a brassiere, comprising:

providing two cups, at least one of the cups being manufactured in accordance with the method of claim 5; and coupling the two cups together to form the brassiere.

* * * * *